US005317853A

United States Patent [19]

Lopes

[11] Patent Number: 5,317,853

[45] Date of Patent: * Jun. 7, 1994

[54] EXPANSION JOINT AND SPHERES THEREFOR

[76] Inventor: Richard W. Lopes, 1124 S. Orange St., Turlock, Calif. 95380

[ * ] Notice: The portion of the term of this patent subsequent to Nov. 7, 2007 has been disclaimed.

[21] Appl. No.: 412,197

[22] Filed: Sep. 25, 1989

[51] Int. Cl.[5] ..... E04C 2/38; E06B 3/70

[52] U.S. Cl. ..... 52/456; 52/656.4; 52/656.7

[58] Field of Search ..... 52/397, 400, 403, 456, 52/393-396, 595, 573, 656.4, 656.7; 49/501

[56] References Cited

U.S. PATENT DOCUMENTS

| | | | |
|---|---|---|---|
| 395,566 | 7/1888 | Merriman | 52/456 |
| 498,344 | 5/1893 | Williams | 52/403 |
| 619,676 | 2/1899 | Cronin | 52/456 |
| 2,083,409 | 6/1937 | Stevens | 52/456 |
| 3,512,304 | 5/1970 | Meuret | 52/456 |
| 3,987,599 | 10/1976 | Hines | 52/589 |
| 4,741,136 | 5/1988 | Thompson | 52/302 |

*Primary Examiner*—James L. Ridgill, Jr.
*Attorney, Agent, or Firm*—Harris Zimmerman

[57] ABSTRACT

An expansion joint for doors of cabinets or for entry doors having a central panel or the like encompassed by a surrounding frame employs small plastic or rubber balls of limited compressibility or hardness dimensioned to tightly fit into tongue and groove joints between panel and frame to accommodate expansion of frame and panel to protect corner glue joints from cracking or contracting.

5 Claims, 1 Drawing Sheet

EXPANSION JOINT AND SPHERES THEREFOR

The present invention relates to the provision of small limitedly compressible balls in the tongue and groove joints of solid panel doors to provide an expansion joint that accommodates expansion or contracting of wood to prevent damage to corner glue joints.

BACKGROUND OF INVENTION

Conventional solid panel doors for cabinets or room entry are formed of a central panel surrounded by wooden rails and stiles in the manner of a frame. The frame is glued together at the corners and conventionally engages the central panel by a mortise and tenon joint such as a tongue and groove arrangement. The door is held together by glueing the outside rails and stiles together at the corners to form the frame surrounding the central panel.

Doors formed as briefly noted above may be damaged by changes in humidity or temperature which cause expansion or contraction of the wood or wood products employed in frame and panel. Such expansion or contraction of the panels applies forces to the corner glue joints of the door which often causes cracking of the joints.

There are, of course, various ingeneous door structures of wood, metal, plastic and the like which may accommodate changes in temperature or humidity but which require the incorporation of complicated joinder devices commonly including gaskets and specially manufactured mating elements. In this respect there is noted prior U.S. Pat. Nos. 3,987,599; 4,741,136, for example.

In sofaras cabinet shops or the like are concerned there does not appear to have been a simple solution to the problem of corner cracking of solid panel doors. The present invention provides such a simple solution which may be readily incorporated in the manufacture of this type of door at minimum expense.

SUMMARY OF INVENTION

The present invention comprises a simple expansion joint for wooden doors and provides limitedly compressible spheres employed in such joints. Wood panel doors are normally formed with a rectangular frame of vertical stiles and horizontal rails that are mortised and glued at the corners of the frame with a central panel having edges fitting into grooves about the interior of the frame.

The expansion joint hereof is provided between the central panel and surrounding frame of doors such as noted above for accommodating expansion or contraction that may result from changes in temperature or humidity and normally applying stress to the corner glue joints of the frame which may crack such joints. The interior of the frame is grooved and the edges of the panel are flanged or formed as tongues to fit into these grooves, as is conventional, however, the preset invention provides for grooves and flanges to be dimensioned so that the flanges fit only part way into the grooves to leave a space at the bottom of the grooves. Small, limitedly compressible, spheres formed of plastic or rubber are placed in the grooves in spaced relation to each other and are dimensioned so as to be somewhat compressed when the door is assembled and the corner joints of the frame are glued. These spheres fit tightly or snugly in the bottom of the grooves and are somewhat compressed in the assembled door.

With the foregoing construction there is formed an expansion joint between the central panel and surrounding frame of a door. Expansion of the frame and panel will squeeze the spheres to further compress them and prevent the application of undue stress upon the glue joints of stiles and rails that may otherwise crack these joints. Contraction of the frame and panel will allow the spheres to expand toward normal size so as to maintain contact between panel and frame so that the panel is not loosened.

BRIEF DESCRIPTION OF DRAWINGS

The present invention is illustrated with respect to a preferred embodiment in the accompanying drawings, wherein.

DESCRIPTION OF PREFERRED EMBODIMENT

Figure 1:
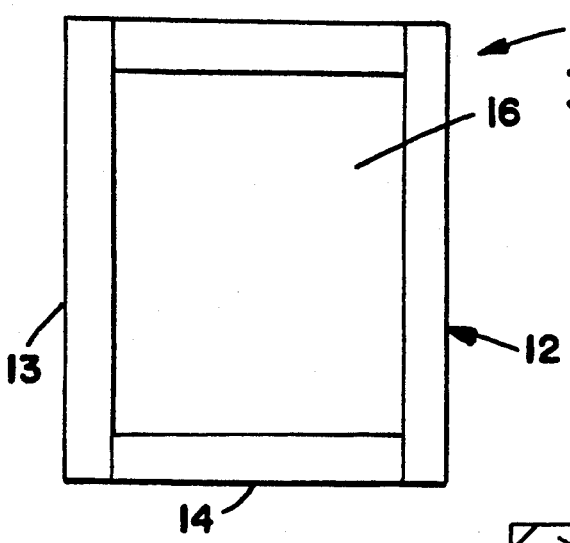
FIG. 1 is an elevational view of a door which may incorporate the present invention.
Figure 2:
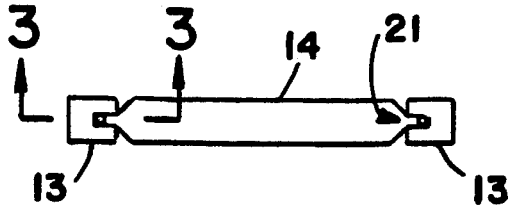
FIG. 2 is a top view of the door of FIG. 1.

The present invention is illustrated and described with respect to the construction of a door which may be employed as a cabinet door, entry door or the like. The invention is particularly adapted to the provision of an expansion joint for solid core wooden doors, and referring to FIGS. 1 and 2 of the drawings, there will be seen to be shown a door 11 comprising an outer frame 12 formed of vertical stiles 13 and horizontal rails 14. A central panel 16 is disposed within the frame 12. The frame 12 is joined together by mortised joints between rails and stiles, as indicated at 21 of FIG. 2.

Figure 3:
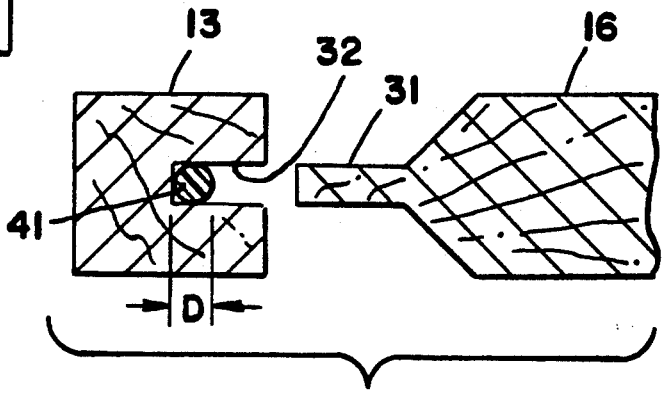
FIG. 3 is an enlarged partial expanded sectional view taken in the plane 3—3 of FIG. 2.

The central panel 16 is mounted within the frame 12 by tongue and groove joints or other types of mortise and tenon joints, and referring to FIG. 3, there will be seen to be provide a tongue or flange 31 about the edges or periphery of the central panel 16, and a groove 32 along the inner side or edge of each of the rails and stiles of the frame 12. The present invention is applicable for use with mortise and tenon joints having a variety of configurations, and the term "tongue and groove" is herein defined to include such variations.

Conventionally, the frame 12 is dimensiond so as to fit tightly about the central panel 16 with the tongue of the latter fully inserted in the groove of the frame when the corner joints of the frame are glued together. Changes in temperature or humidity, however, cause expansion or contraction of the panel and frame. Expansion of the frame, for example, will cause the inner dimension thereof to decrease, and similarily expansion of the panel will the cause the outer dimension to increase so as to apply a force against the frame pushing the rails and stiles outwardly. This condition applies a force to the corner glued joints of the frame and may crack the joints. Alternatively, contraction of the panel and/or the frame will loosen the panel in the frame so that it may rattle.

Figure 4:
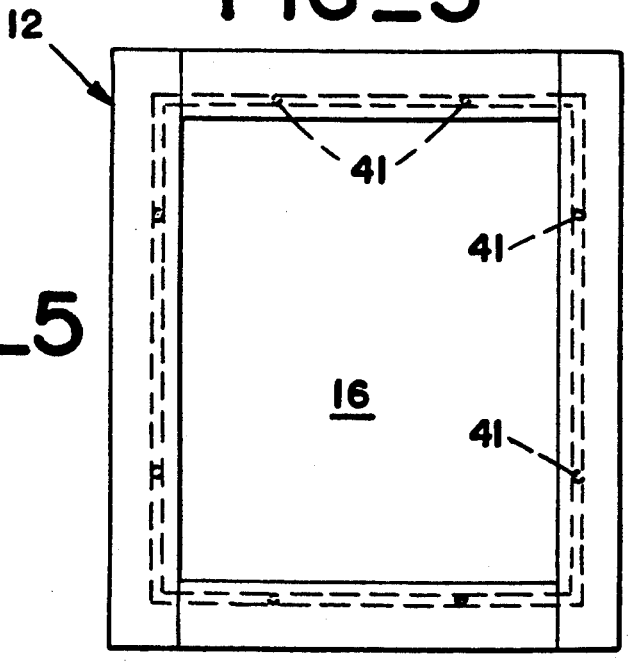
FIG. 4 is an elevational view of a door illustrating the expansion joint hereof.

The present invention provides an expansion joint in the tongue and groove connection of panel and frame by the provision of compressible spheres 41 disposed in the groove 32 about the inner edge of the frame 13. These spheres 41 are located about the periphery of the panel in the frame groove 32, as indicated in FIG. 4. There may, for example, be provided a pair of spheres on each side and top and bottom of the panel, as shown.

Considering further the spheres 41, it is noted that same are formed of a plastic or rubber material having a limited compressibility and this may be best defined by the hardness of the spheres. In accordance with the present invention the spheres have a hardness of 32 to 55 durometer, which is a scale of hardness commonly employed for rubber.

Figure 5:
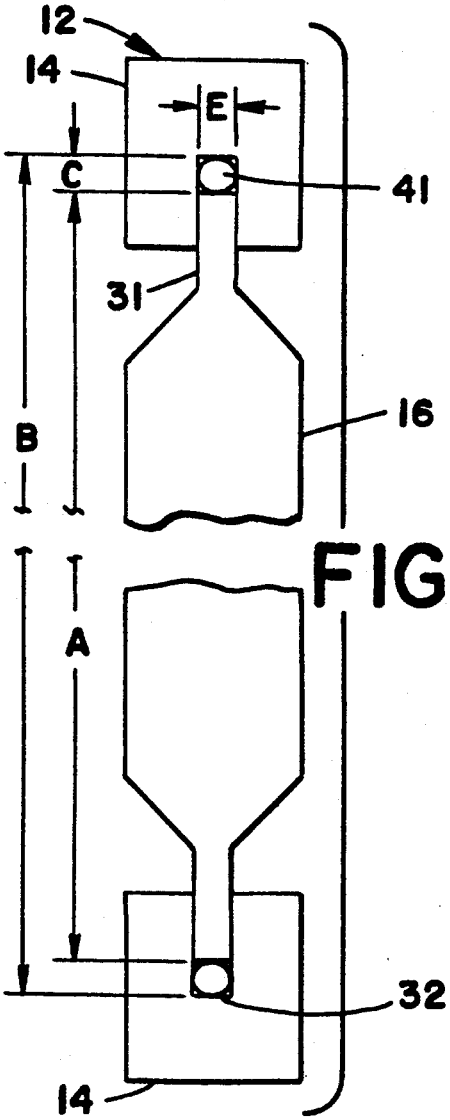
FIG. 5 is a schematic illustration of a door incorporating the present invention and indicating relative dimensions pertinent to the invention.

Considering further the expansion joint of the present invention, and referring to FIG. 5 comprising a schematic illustration of a door incoporating the expansion joint hereof, the door 12 is shown to have a panel 16 with an overall width A between extremities of the tongues 31 on opposites edges thereof. The frame 12, in assembled and glued condition, has a dimension B between the bottom of opposite grooves 32. The panel width A is less than the width or distance between groove extremities B by the amount C at each edge of the panel, i.e. $B=A+2C$. This space C is occupied by a sphere 41 having diameter D wherein D is greater than C. Thus the assembled door has spheres in the frame grooves 32 with such spheres being somewhat compressed from the normal spherical shape.

Expansion of the frame and/or panel will thus further compress the spheres 41 to accommodate a decrease in the distance C without applying undo forces to the frame that might otherwise crack the corner joints thereof. In the alternative, contraction of the panel 16 to reduce the distance A, and/or contraction of the frame 12 to increase the distance B, will cause an increase in the distance C which is accommodated by expansion of these spheres 41 toward their original diameter. This will then prevent the panel from becoming loose in the frame grooves so that the panel is still snugly held in the frame. It will be appreciated that the same expansion and contraction is accommodated both vertically and horizontally in a door employing the expansion joint of the present invention. It is also noted that under certain circumstances it is possible to employ the expansion joint hereof only on one side and either the top or bottom of the door, however, this requires the spheres to accommodate somewhat greater compression and expansion.

With regard to the assembly of a door employing the expansion joint of the present invention, it is noted that spheres 41 are preferably formed of a diameter D which is slightly greater than the width E of the groove 32 about the interior of the frame 12. The spheres may be than be forced into the groove at desired locations as by minimal indentation of the wood of the frame so as the rest in the bottom of the grooves at desired positions about the frame. The door is then assembled in normal manner by placing the stiles and rails about the panel engaging the spheres in the frame grooves and gluing the corner mortised joints of the frame. It will, of course, be appreciated that the corners of the door frame may be mitered and mortised in order to accommodate the use of the contoured rails and stiles. The type of corner joint for the frame is not limiting upon the present invention and the illustration of a simple mortised joint is employed for simplicity of illustration.

The compressible spheres of the expansion joint hereof provide a simple solution to the problem of cracking or separating corner joints of door frames with changes in temperature and humidity. It is again noted that these spheres are particularly dimension with respect to the panel and frame of a door and particularly with respect to the depth of the tongue and groove engagement of panel and frame. In addition, the spheres are provided with a particular limited compressibility and resiliency so as to accommodate forcible compression of the spheres and subsequent expansion of same upon the release of such forces. In this manner, the panel of a door is at all times maintained in tight contact with the surrounding frame without the conventional rigid engagement which may transmit destructive forces to the frame it self. The present invention is particularly adapted for use in cabinet shops and the like by the ease of incorporation into the door structure and the superior results attainable therefrom. Doors formed with the expansion joint of the present invention have been found to be free from damage to corner joints otherwise occurring from changes in temperature and humidity.

The present invention has been described above with respect to a single preferred embodiment thereof, however, it will be appreciated by those skilled in the art that modifications and variation are possible within the scope of the present invention and thus it is not intended to limit the invention to precise terms of description or details of illustration.

What is claimed is:

1. An expansion joint in a wooden door having a frame surrounding a central panel comprising:

said frame having a groove about the interior thereof, a tonque forming at least a portion of the edge of said panel and which extends into said groove for a distance that is smaller than the depth of said groove, portions of said tongue that are outside of said groove being proportioned for entry into said groove in the event of expansion of said panel, and a plurality of spheres of limitedly compressible resilient material disposed in said groove in spaced relation thereabout and being dimensioned to be partially compressed between said frame and panel during assembly of said door, whereby said spheres continue to engage said frame and panel during expansion and contraction thereof.

2. The expansion joint of claim 1 wherein the dimension of said panel including said tongue is less than the distance between frame sides measured from the bottom of said groove by a distance that is limitedly less than the combined diameters of two of said spheres.

3. The expansion joint of claim 1 further defined by said spheres being formed of plastic or rubber and having a hardness in the range of 32–55 durometer.

4. The expansion joint of claim 1 further defined by said frame being formed of rails and stiles glued at the corners of the frame and wherein said groove contains at least two separated spheres at each rail and stile for evenly accommodating expansion and contraction of said frame and/or said panel.

5. The expansion joint of claim 1 wherein said groove has a width that is smaller than the diameter of said spheres when said spheres are in an uncompressed condition.

* * * * *